US005573166A

United States Patent [19]

Leja

[11] Patent Number: 5,573,166

[45] Date of Patent: Nov. 12, 1996

[54] HIKER'S DAY PACK

[76] Inventor: Laurie A. Leja, S. Main St., P.O. Box 155, Rindge, N.H. 03461

[21] Appl. No.: 390,211

[22] Filed: Feb. 16, 1995

[51] Int. Cl.[6] ..... A45F 3/04

[52] U.S. Cl. ..... 224/630; 224/651; 224/652; 224/644

[58] Field of Search ..... 224/209, 214, 224/215, 224, 228, 907, 148, 155, 630, 637, 645, 651, 652, 644

[56] References Cited

U.S. PATENT DOCUMENTS

| | | | |
|---|---|---|---|
| 2,324,194 | 7/1943 | Campiglia | 224/215 |
| 4,609,084 | 9/1986 | Thomas | 224/209 X |
| 4,830,245 | 5/1989 | Arakaki | 224/907 |
| 4,925,064 | 5/1990 | Comora | 224/155 |
| 5,114,059 | 5/1992 | Thatcher | 224/209 |

FOREIGN PATENT DOCUMENTS

| | | | |
|---|---|---|---|
| 104694 | 6/1942 | Sweden | 224/209 |

*Primary Examiner*—Renee S. Luebke

[57] ABSTRACT

A hiker's day pack comprising: a backpack being formed of one or more walls, each wall having an exterior surface and an interior surface, the backpack including adjustable shoulder straps affixed thereto, the shoulder straps permitting users to carry the apparatus on their backs, a plurality of pockets and retainment devices being positioned on the exterior surface of the backpack, the pockets permitting the user to retain a plurality of different items therein, the backpack including coupling devices to permit retraction of a wall thereof, the interior of the backpack including a plurality of pockets and retainment devices, the pockets and retainment devices adapted to firmly restore various items and supplies therein.

1 Claim, 3 Drawing Sheets

HIKER'S DAY PACK

BACKGROUND OF THE INVENTION

1. Field of the Invention

The present invention relates to a hiker's day pack and more particularly pertains to storing and organizing supplies for outdoor day trips.

2. Description of the Prior Art

The use of backpacks is known in the prior art. More specifically, backpacks heretofore devised and utilized for the purpose of carrying a plurality of items are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,129,560 to Herman a utility bag system.

U.S. Pat. No. 4,673,117 to Calton discloses a backpack cooler construction.

U.S. Pat. No. 3,902,640 to Geiben discloses a hiker's back pack.

U.S. Pat. No. 5,230,450 to Mahvi et al. discloses a infant care bag.

Lastly, U.S. Pat. No. 4,561,578 to Bell discloses a backpack for hikers.

In this respect, the hiker's day pack according to the present invention substantially departs from the conventional concepts and designs of the prior art, and in doing so provides an apparatus primarily developed for the purpose of storing and organizing supplies for outdoor day trips.

Therefore, it can be appreciated that there exists a continuing need for a new and improved hiker's day pack which can be used for storing and organizing supplies for outdoor day trips. In this regard, the present invention substantially fulfills this need.

SUMMARY OF THE INVENTION

In view of the foregoing disadvantages inherent in the known types of backpacks now present in the prior art, the present invention provides an improved hiker's day pack. As such, the general purpose of the present invention, which will be described subsequently in greater detail, is to provide a new and improved hiker's day pack and method which has all the advantages of the prior art and none of the disadvantages.

To attain this, the present invention essentially comprises a new and improved hiker's day pack comprised of a backpack, a retractable flap, a plurality of pockets, and a plurality of camping supplies.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hiker's day pack which has all of the advantages of the prior art backpacks and none of the disadvantages.

It is another object of the present invention to provide a new and improved hiker's day pack which may be easily and efficiently manufactured and marketed.

It is further object of the present invention to provide a new and improved hiker's day pack which is of durable and reliable constructions.

An even further object of the present invention is to provide a new and improved hiker's day pack which is susceptible of a low cost of manufacture with regard to both materials and labor, and which accordingly is then susceptible of low prices of sale to the consuming public, thereby making such hiker's day pack economically available to the buying public.

Still yet another object of the present invention is to provide a new and improved hiker's day pack which provides in the apparatuses and methods of the prior art some of the advantages thereof, while simultaneously overcoming some of the disadvantages normally associated therewith.

Still another object of the present invention is to store and organize supplies for outdoor day trips.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
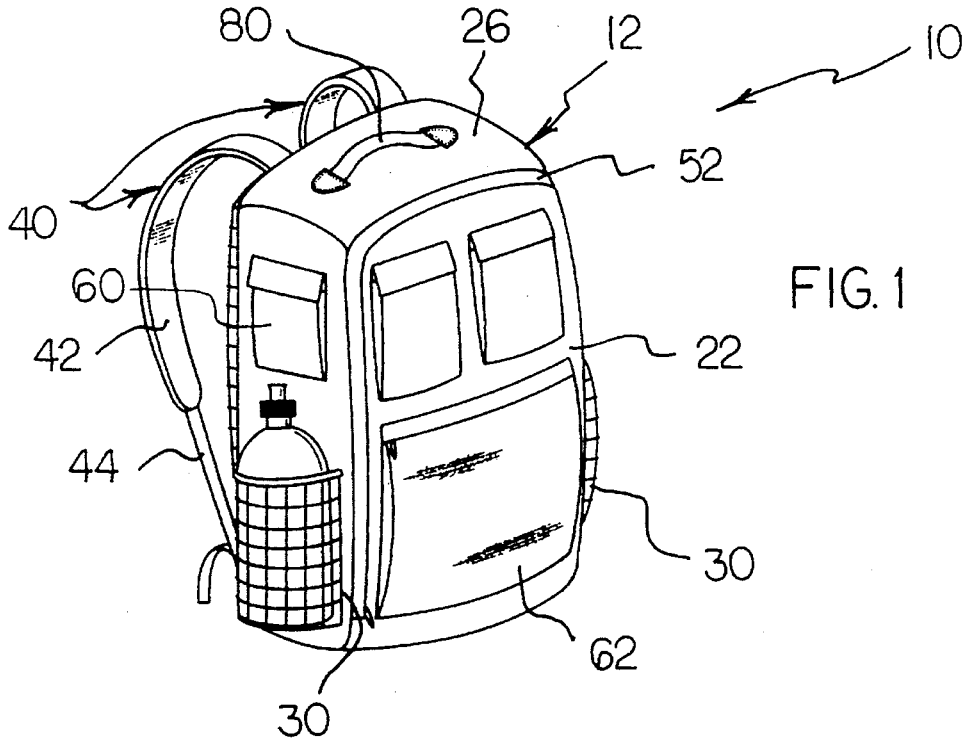
FIG. 1 is a perspective view of the preferred embodiment of the hiker's day pack constructed in accordance with the principles of the present invention.

With reference now to the drawings, and in particular to FIG. 1 thereof, the preferred embodiment of the new and improved hiker's day pack embodying the principles and concepts of the present invention and generally designated by the reference numeral 10 will be described.

The present invention, the hiker's day pack 10 is comprised of a plurality of components. Such components in their broadest context include a backpack 12, a retractable flap 14, and a plurality of camping supplies 16. Such components are individually configured and correlated with respect to each other so as to attain the desired objective.

Figure 2:
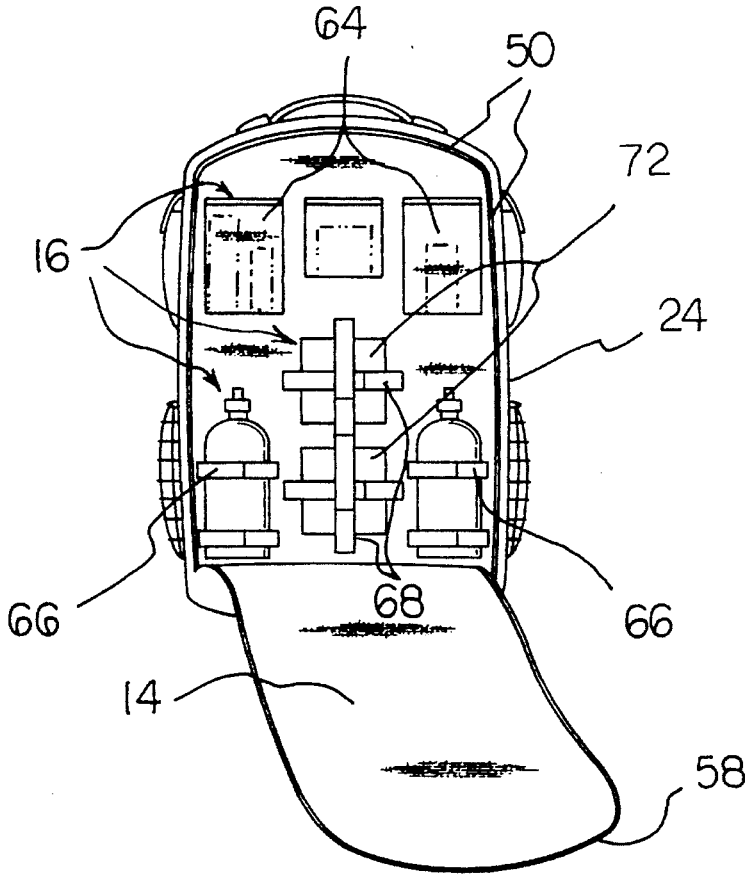
FIG. 2 is a rear perspective view of the apparatus with the back flap positioned in the uncoupled orientation.

More specifically, the backpack 12 is formed in an essentially hollow rectangular shaped configuration. The backpack has a front wall 20, a rear wall 22, two side walls 24, a roof 26 and a floor 28. The interior of the backpack is large enough to house a wide variety of different camping supplies. The supplies which are contained within the interior of the backpack are affixed to the inner surface of the front wall of the apparatus. Note FIGS. 1 and 2.

Each of the walls are positioned vertically in the operative orientation. Each wall has an upper region and a lower region. The lower region of each side wall includes a generally rectangular shaped mesh fabric sack 30 positioned upon it. Each sack permits the placement of a fluid bottle securely within it. The fluid bottles are positioned within the sacks of each side wall to enable the user to easily reach back and access the bottles without having to take the backpack off. A plurality of different types of beverages may be contained within the fluid bottles. Note FIG. 1.

Figure 3:
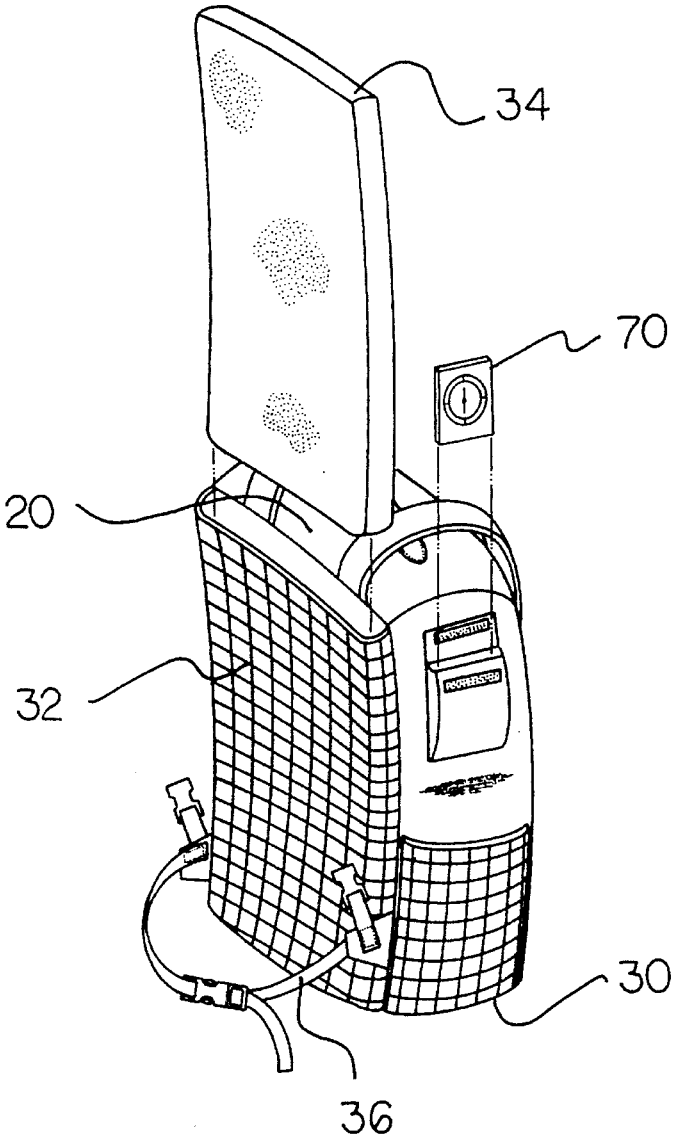
FIG. 3 is a side perspective view of the apparatus illustrating the positioning of the foam pad in the front wall of the apparatus.

The front wall 20 includes a mesh fabric pouch 32. The pouch extends essentially the entire height and width of the front wall. A foam pad 34 is formed in a planar generally rectangular configuration and is adapted to be positioned within the mesh pouch. The foam pad serves three functions. The foam pad rests against the user's back when carrying the apparatus and makes it more comfortable to carry. The foam pad also provides additional insulation for food stored inside the back pack. Another use of the foam pad is to enable the user to remove it from the sack and sit on it when taking a rest break. Note FIG. 3.

The upper region of each side wall and front wall includes a generally rectangular shaped pocket 60. The pockets include coupling means to permit securing of various items within them. The coupling means may be in the form of VELCRO, a pile type fastener zippers, or buttons. The roof of the backpack includes a handle 80. The front wall has adjustable waist straps 36 affixed to its lower region. The waist straps are adapted to be positioned around the user's waist. The waist straps ensure that the back pack fits securly and comfortably around the user's back and torso. The uppermost extent of the front region has two shoulder straps 40 which extend from it. Each shoulder strap has a wide upper segment 42 and a thin lower segment 44. The upper segment is adapted to be positioned across the user's shoulders. The upper segments of the shoulder straps include padding to enhance comfort to the user while carrying the apparatus. Note FIGS. 1 and 3.

Figure 6:
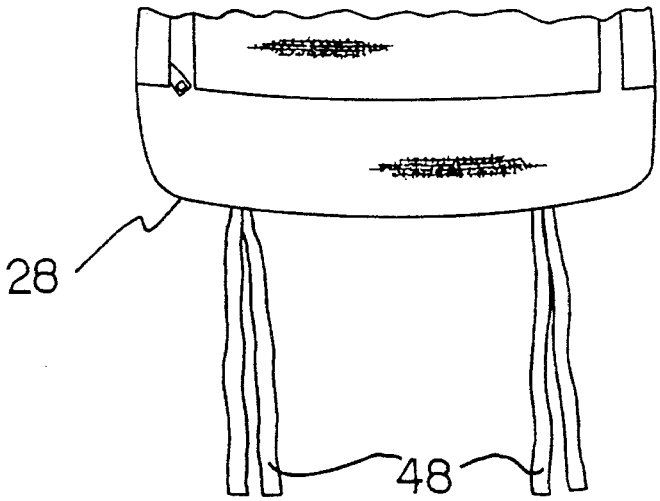
FIG. 6 is a broken away perspective view of the bottom of the pack illustrating the blanket roll straps thereof.

The lower segment is coupled to the waist straps of the apparatus. The floor 28 of the back pack includes a plurality of blanket roll straps 48. Note FIG. 6. The periphery of the rearward extent of the roof and sidewalls of the backpack includes closure means 50. The closure means includes a covering 52 to prevent damage from adverse weather conditions. Precipitation in the form of rain or snow can cause exposed metal zippers to rust. Note FIGS. 1–3.

The majority of the rear wall is formed as a generally rectangular shaped retractable flap 14 with an inner surface and an outer surface. The lowermost extent of the flap is formed contiguously with the floor of the backpack. The perimeter of the flap has closure means 58 affixed to it. The closure means of the flap is adapted to be coupled with the closure means on the roof and sidewalls of the backpack. In an alternative embodiment of the apparatus the flap is coupled to the roof and side walls of the backpack with either VELCRO fasteners or buttons. The closure means enable the user to quickly and efficiently access the interior contents of the back pack when needed. Note FIG. 2.

The outer surface of the flap has two additional generally rectangular shaped pockets 60 affixed to it. The pockets include coupling means to securely retain items positioned within them. The lower region of the outer surface of the rear wall includes a large pocket 62. The pockets are adapted to hold a plethora of different items such as maps, nature books, snacks and compasses etc. Note FIGS. 1 and 3.

The interior surface of the front wall has two side regions and a central region therebetween. Each side region includes at least one large snack pocket 64 and at least one parallel pair of VELCRO a pile type fastener coupling means 66. The central region includes at least one perpendicular pair of VELCRO a pile type fastener coupling means 68. The VELCRO a pile type fastener coupling means permits releasable coupling of water bottles and other objects therein. The pockets and coupling means within the interior of the backpack help organize essential items for easy accessibility. The pockets also insulate food and prevent spills. The secure coupling means prevent jostling and overturning of the items contained therein while hiking and removing the backpack. Note FIG. 2.

Figure 4:
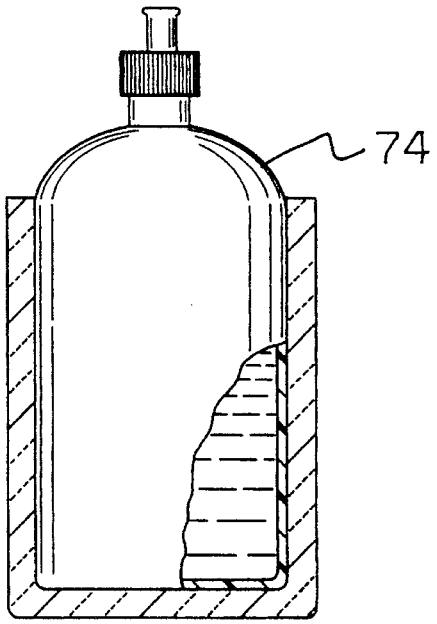
FIG.4 is a partially broken away perspective view of a water bottle of the apparatus.
Figure 5:
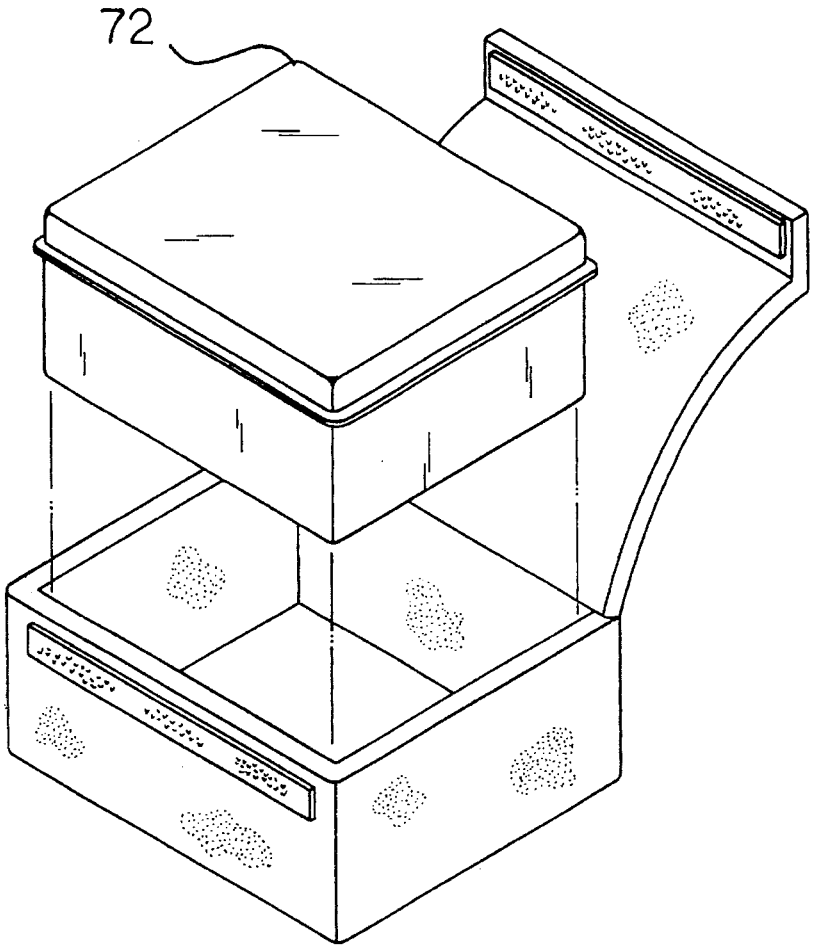
FIG. 5. is a perspective view of an insulated liner and a sandwich container.

A plurality of camping 16 supplies are included with the apparatus. A compass 70 is dimensioned to be positioned in a pocket of the backpack. The compass is useful for hiking safety and educational purposes. At least four sandwich containers 72 are dimensioned to be positioned within the perpendicular pairs of VELCRO a pile type fastener coupling means. In an alternative embodiment of the apparatus insulated liners are utilized to retain each sandwich container. At least four insulated fluid bottles 74 are formed in a generally cylindrical configuration. Two fluid bottles are dimensioned to be positioned within the parallel pairs of coupling means in the interior of the backpack. Two fluid bottles are dimensioned to be positioned in the mesh pockets of the side walls of the apparatus. The bottles can hold a plurality of different types of fluids. In alternative embodiments of the apparatus the fluid bottles are formed in a variety of sizes and shapes to accommodate the needs of different users. The fluid bottles each include an insulated lining to help maintain the desired temperature of the fluid therein while hiking or camping. Note FIGS. 1 and 4.

The hiker's day pack is a back pack specially designed for day trips outdoors. The apparatus is ideal for hiking, fishing, hunting, bicycling, or attending sports events. It is designed to organize and make essential items readily accessible, insulate food while preventing spills, and provide comfort and convenience to the user. The hiker's day pack comes with four plastic beverage containers and four sandwich containers that are held securely in their designed location with VELCRO a pile type fasteners straps. Several insulated pouches are provided to hold snack foods.

The side of the hiker's day pack which rests against the user's back consists of a large mesh pocket that holds a removable cushion. This makes the pack comfortable to carry and provides additional insulation for food inside the pack. The pad may be easily removed and sit upon when taking a rest break.

Outside pockets are designed to retain beverage containers, maps, nature books, and other desired items within reach. A compass is included with the hiker's day pack and is useful for hiking safety and education. Straps on the bottom of the hiker's day pack can be used to hold a rolled up blanket, coat, or other gear. Zippers or VELCRO are used for closures of compartments and pockets.

The hiker's day pack is a workable back pack for avid hikers. The apparatus includes a compass, four water bottle containers, four sandwich containers and various compartments on its interior and exterior. On the front wall an additional compartment is made from a mesh fabric to house a removable cushion for seating purposes.

One of the advantages of the present invention over the others is that much of the user's gear is strapped down with VELCRO a pile type fasteners. This method prevents spilling and insures easy access to the user's supplies. The exterior water bottles also create an advantage. While hiking, instead of having to stop and take the pack off, the user simply reaches back and grabs his bottle. When it is time to take a break, instead of sitting on a hard surface, the user can sit on the foam cushion component of the back pack. There are additional straps located at the base of the back pack to secure blankets or gear that the user may require. The enclosed compass is a useful feature and provides an educational tool for children and adults.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved hiker's day pack comprising, in combination:

a backpack formed in an essentially hollow rectangular shaped configuration, the backpack having a front wall, a rear wall, two side walls, a roof and a floor, each of the walls being positioned vertically in an operative orientation, each wall having an upper region and a lower region, the lower region of each side wall including a generally rectangular shaped mesh fabric sack positioned thereupon, each sack permitting the placement of supplies therein, the front wall including a mesh fabric pouch, the pouch extending essentially the entire height and width of the front wall, a foam pad being formed in a planar generally rectangular configuration and dimensioned to be positioned within the mesh pouch, the upper region of each side wall including a generally rectangular shaped pocket, the pockets including coupling means to permit securing of various items therein, the roof of the backpack including a handle, the front wall having adjustable waist straps affixed to its lower region, the straps adapted to be positioned around a user's waist, an uppermost extent of the front region having two shoulder straps extending therefrom, the shoulder straps having a wide upper segment and a thin lower segment, the upper segment adapted to be positioned across the user's shoulders, the lower segment being coupled to the waist straps, the floor of the back pack including a plurality of blanket roll straps, the periphery of the rearward extent of the roof and sidewalls of the backpack including closure means, the closure means including a covering to prevent damage from adverse weather conditions;

a majority of the rear wall being formed as a generally rectangular shaped retractable flap with an inner surface and an outer surface, a lowermost extent of the flap being formed contiguously with the rear wall, the perimeter of the flap having closure means affixed thereto, the closure means of the flap adapted to be coupled with the closure means on the roof and sidewalls of the backpack, the outer surface of the flap having two generally rectangular shaped pockets affixed thereto, the pockets including coupling means to securely retain items positioned therein, the lower region of the outer surface of the rear wall including a large pocket;

the interior surface of the front wall having two side regions and a central region therebetween, each side region including at least one large snack pocket and at least one parallel pair of VELCRO, a pile type fastener, coupling means, the central region including at least one perpendicular pair of VELCRO, a pile type fastener, coupling means, the VELCRO, a pile type fastener, coupling means permitting releasable coupling of various objects therein;

camping supplies being included with the apparatus, the camping supplies including a compass dimensioned to be positioned in a pocket of the apparatus, at least four sandwich containers dimensioned to be positioned within the perpendicular pairs of VELCRO, a pile type fastener, coupling means, at least four insulated water bottles formed in a generally cylindrical configuration, two fluid bottles dimensioned to be positioned within the parallel pairs of coupling means in the interior of the backpack, two fluid bottles dimensioned to be positioned in the mesh pockets of the side walls of the apparatus.

* * * * *